United States Patent [19]

Knispel et al.

[11] Patent Number: 4,619,394

[45] Date of Patent: Oct. 28, 1986

[54] RIVETING ATTACHMENT FOR A STAPLE GUN

[75] Inventors: Barry Knispel, Hillsdale; Rudolf Wingert, W. Milford, both of N.J.

[73] Assignee: Arrow Fastener Company, Inc., Saddle Brook, N.J.

[21] Appl. No.: 632,628

[22] Filed: Jul. 19, 1984

[51] Int. Cl.[4] ..... B25B 31/00; B25C 5/00

[52] U.S. Cl. ..... 227/156; 227/109; 227/132; 72/341; 29/243.53

[58] Field of Search ..... 227/109, 120, 130, 1, 227/132, 156; 72/391, 437, 445; 29/243.53

[56] References Cited

U.S. PATENT DOCUMENTS

| | | | |
|---|---|---|---|
| 3,442,112 | 5/1969 | Abromavage et al. | 72/391 |
| 3,724,738 | 4/1973 | Hurst | 227/147 |
| 3,998,372 | 12/1976 | Leonardo et al. | 227/149 X |
| 4,051,991 | 10/1977 | Goodchild | 227/155 |
| 4,089,099 | 5/1978 | Nivet | 72/391 X |
| 4,184,357 | 1/1980 | Stubbings | 72/391 |
| 4,511,074 | 4/1985 | Kille et al. | 227/120 X |

FOREIGN PATENT DOCUMENTS

| | | | |
|---|---|---|---|
| 2097313 | 11/1982 | United Kingdom | 227/156 |

*Primary Examiner*—Robert L. Spruill
*Assistant Examiner*—Taylor J. Ross
*Attorney, Agent, or Firm*—Pasquale A. Razzano

[57] ABSTRACT

An attachment for a staple gun tacker having a staple driving blade is disclosed which is adapted to be used in driving and setting a rivet of the type having a pin member mounted in a headed rivet shank having an expandable workpiece piercing free end. The attachment includes a housing adapted to be frictionally engaged on the working end of a staple gun tacker and having a bore located to be generally in axial alignment with the driving blade of the staple gun tacker. A hollow bushing is mounted in the housing bore and a pin punch is slidably mounted in the bushing for axial movement therein. A spring biases the pin punch towards the driving blade of the staple gun tacker with the bushing and pin being positioned such that the pin punch is impacted by the driving blade of the staple gun tacker when it is operated to apply a driving force thereto, which force is used to drive the pin member of the rivet to expand the free end of the rivet.

16 Claims, 7 Drawing Figures

RIVETING ATTACHMENT FOR A STAPLE GUN

The present invention relates to attachments for staple gun tackers, and more particularly to an attachment which is useful in driving rivets with a staple gun tacker.

BACKGROUND OF THE INVENTION

Various types of rivet driving tools have been previously proposed for use by the homeowner or "do it yourselfer". These devices generally consist of special purpose hand tools associated with specially designed rivets to enable the homeowner to rivet pieces of sheet metal or other workpieces together in a simple and relatively inexpensive manner. However, in each instance a separate special tool is required.

To overcome the need for a separate special riveting tool, certain devices have been previously proposed such as, for example, are disclosed in German Gebrauchsmuster No. 8223170.2, filed Aug. 17, 1982. In the device disclosed in that German Gebrauchsmuster, an attachment is adapted to be fitted on the working end of a staple gun tacker so that the blade of the tacker drives a pin into a hollow rivet. The pin is slidably mounted in the attachment, and its movement into the bore of the rivet causes the rivet to flare or expand in a hole in the workpiece, thereby securing the rivet to the workpiece. With the device disclosed in that Gebrauchsmuster however, there are a number of problems in that the driving pin can easily be removed or fall from the attachment and be lost. In addition, the driving pin of the attachment enters the rivet and can become jammed. Moreover, it is relatively difficult to align the driving pin with the rivet prior to operation of the staple gun tacker.

Another system for installing rivets is disclosed in U.S. Pat. No. 3,724,738. In that case a specially designed rivet is provided in which a driving pin is mounted in the rivet itself and a driving member is, somehow, impacted against the driving pin to force the rivet to expand. However, the patent does not disclose how the driving force is applied.

It is an object of the present invention to provide a relatively simple attachment for use on a conventional hand-operated staple gun tacker which will enable rivets to be driven into a workpiece.

Another object of the present invention is to provide an attachment for a staple gun tacker which will permit rivets to be driven by the tacker.

Yet another object of the present invention is to provide a relatively simply constructed and inexpensively manufactured rivet attachment for a staple gun tacker.

A further object of the present invention is to provide a reliable and easily guided riveting attachment for a staple gun tacker device.

The above, and other objects, features and advantages of the present invention will be apparent from the following detailed description of an illustrative embodiment thereof, when read in connection with the accompanying drawings, wherein:

DETAILED DESCRIPTION

Figure 1:
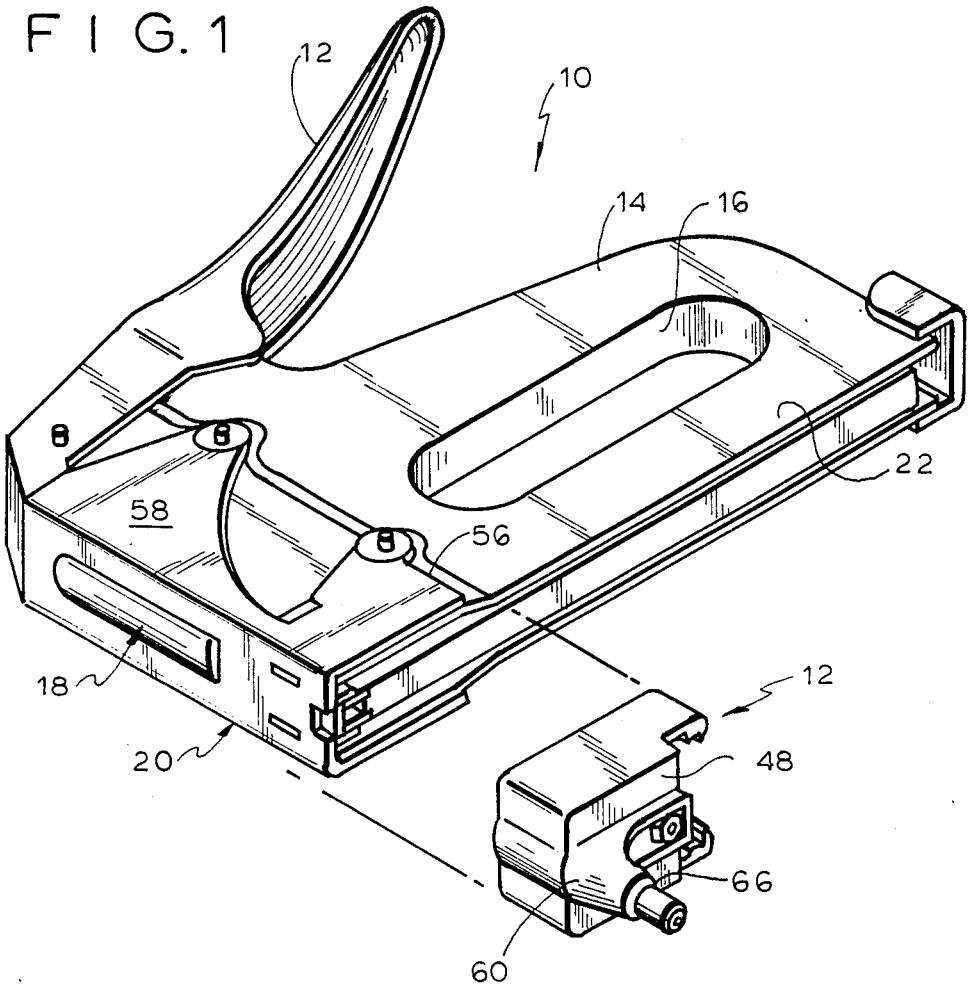
FIG. 1 is a perspective view of a conventional staple gun tacker and the associated rivet installing attachment of the present invention.

Referring now to the drawing in detail, and initially to FIG. 1 thereof, a conventional staple gun tacker 10 is illustrated, along with a rivet installing attachment 12 constructed in accordance with the present invention. The staple gun tacker 10 is of known construction and is available from the Arrow Fastener Company, Inc. of Saddle Brook, N.J. The product is sold under the trademark "T-50". The Arrow T-50 staple gun tacker has been on the market to the public for over thirty years and is of a known construction. It is a general purpose heavy-duty stapling tool, used in millions of homes throughout the country for various "do it yourself" applications, such as installation of insulation. The outside overall appearance of the T-50 staple gun tacker is so well known that the U.S. International Trade Commission has declared it to be a trademark.

Staple gun tacker 10 includes an operating handle 12 pivotally mounted on a main housing 14. The latter includes a finger opening 16 and a drive mechanism 18 contained within the working end 20 at the forward portion of the tacker. In use as a staple gun tacker, the base portion 22 of the staple gun contains a magazine of staples, adhered together in a known manner, as a cartridge. By inserting the fingers of the hand in the opening 16 while pressing the handle 12 with the palm, the user of the staple gun tacker operates the drive mechanism 18 to move its drive blade 68 in the forward end of the device and cause it to drive a staple in a known manner.

In accordance with the present invention, the staple gun tacker is not modified in any way when the attachment 12 is secured thereto for the purpose of installing rivets. The only modification from the normal operation of the staple gun tacker is that no staples are present in the magazine or the magazine is removed when the device is operated for the purpose of installing rivets.

Figure 4:
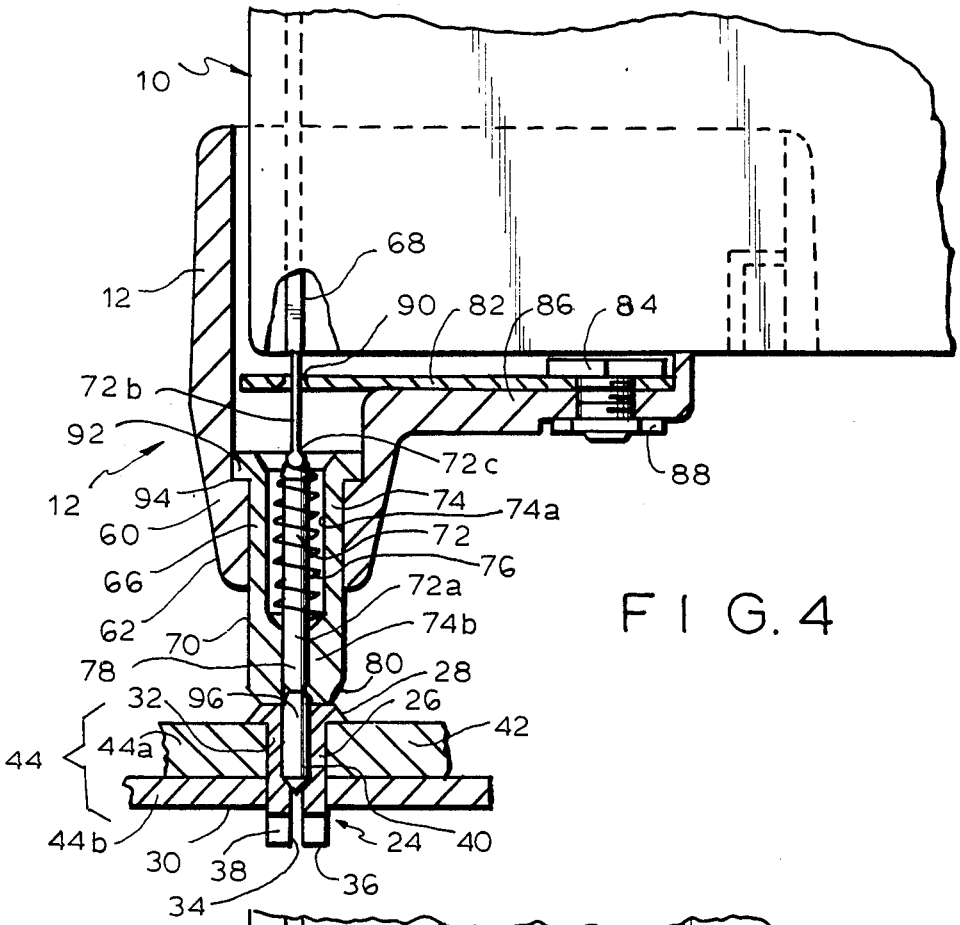
FIG. 4 is a side sectional view of the attachment mounted on the working end of the staple gun tacker, in position prior to operation of the tacker.

Attachment 12 is designed for use with a specially constructed rivet 24, of a general known construction type test is commercially available. However, in accordance with the present invention, applicants have found that the rivet must be modified from its conventionally available commercial design to specific tolerances as described hereinafter. A The rivet, as seen in FIG. 4, includes an outer rivet member having a shank 26 and a head 28. The shank and head have an internal bore 30 which includes an upper bore section 32 of larger diameter than the lower bore section 34. The lower or piercing end 36 of the rivet has two or more slots 38 formed therein to facilitate the spreading of the piercing end of the rivet upon operation of attachment 12. It is to be understood that while end 36 is referred to as a piercing end, because it passes through the work piece, it performs no cutting action but is placed in a predrilled hole in th work piece before the staple gun tacker is operated to spread it.

The rivet includes a drive pin 40 frictionally engaged in the upper bore portion 32 of the rivet shank. The diameter of pin 40 is approximately the same as the diameter of the upper section 32 of the bore, but larger than the lower section 34 of the rivet bore. When attachment 12 is mounted on the staple gun tacker and operated as described hereinafter, pin 40 is driven into the rivet (which had been previously manually placed in the predrilled bore 42 in workpiece 44) thereby forcing the pin into the lower bore section and spreading out the piercing end of the rivet.

Applicants have found that the tolerances of the rivet design are extremely critical to the operation of the attachment 12 in connection with the staple gun tacker. While rivets of the general type of construction just described have been available for installation with other tools, or even with a hammer, it has been found that the attachment will operate most successfully if pin 40 has an external diameter of 0.077 inches plus or minus 0.002 as a tolerance. This pin also has knurls on its outer surface to retain the pin in the rivet during storage and transportation prior to use. These knurls preferably have a diameter of between 0.081 to 0.085 inches. The diameter of the bore section 32 in the rivet is preferably 0.080 inches plus no more than 0.003 inches in diameter. With these specific tolerances for the rivet, applicants have found that the staple gun tacker will provide sufficient power to drive pin 40 to operate the rivet satisfactorily in a wide variety of applications. With greater tolerances, the pin may not be driven satisfactorily, and with lesser tolerances the pin may be driven through the rivet entirely without satisfactory spreading of the piercing end thereof.

In the illustrative embodiment shown in FIG. 4 workpiece 44 consists of two elements 44*a* and 44*b* to be joined together by the rivet. These elements have a hole 42 drilled therein which receives the rivet before pin 40 is driven. Of course, it is to be understood that the length of the shank portion of the rivet may be varied as desired, depending upon the thickness of the workpieces to be joined.

Figure 2:
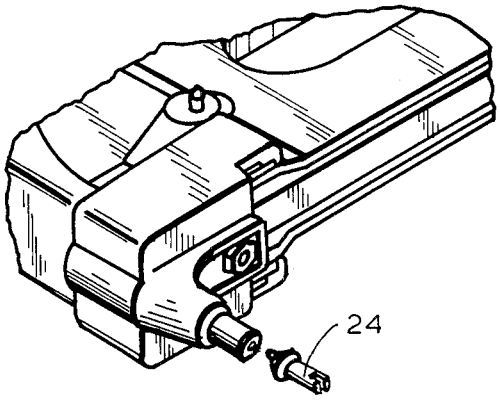
FIG. 2 is a partial perspective view showing the attachment mounted on the staple gun tacker.
Figure 3:
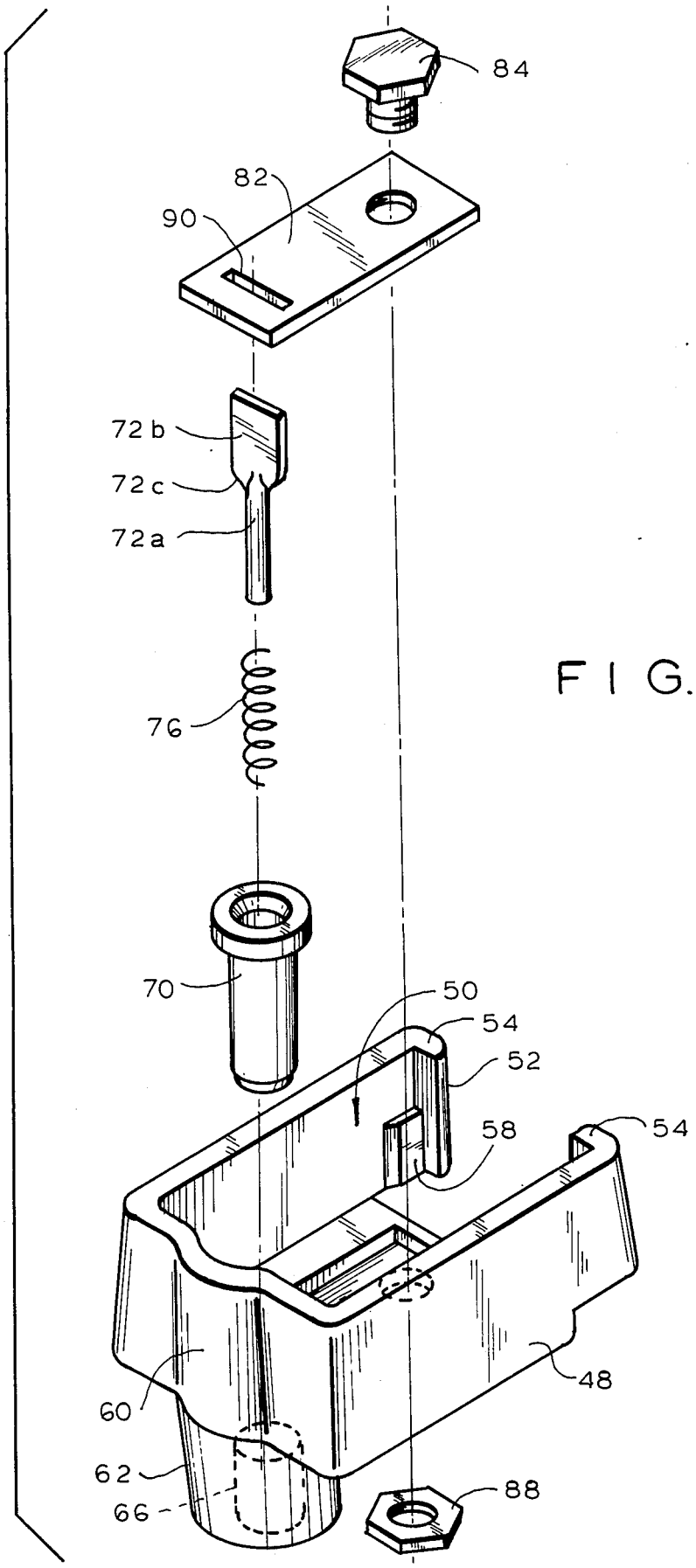
FIG. 3 is an exploded perspective view of the rivet installing attachment of the present invention.
Figure 7:
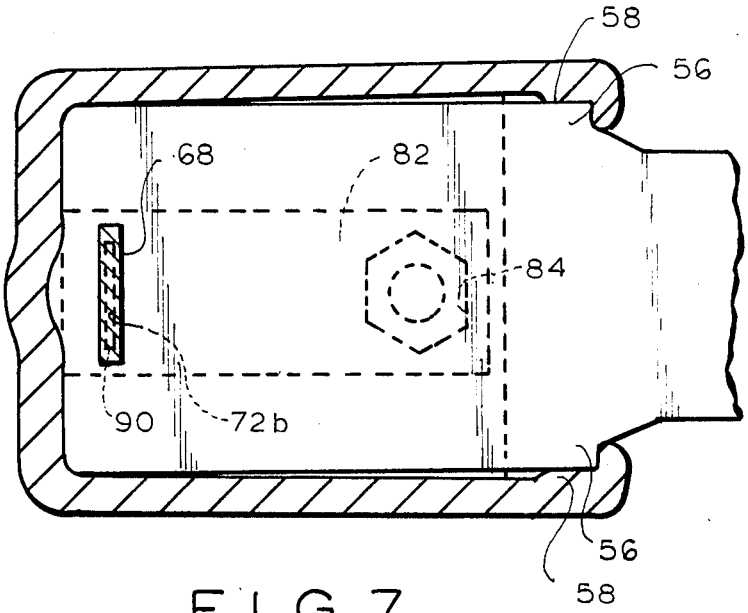
FIG. 7 is a sectional view taken along lines 7—7 of FIG. 6.

Referring again to FIGS. 1 and 2 of the drawing, riveting attachment 12 of the invention includes a housing 48 which is adapted to be mounted on the working end 20 of the staple gun tacker 10. As seen in FIG. 3, housing 48 has a generally rectangular internal opening or recess 50 formed therein which will accommodate the working end of the staple gun tacker. The recess has an opening 52 at its rear end which includes flanges 54 that wrap about the rear end 56 of the front cover 58 of the staple gun tacker. Bosses 56 on opposite faces of the side walls of housing 48 serve to frictionally engage the sides of front cover 58 of the staple gun tacker to hold the attachment thereon, as seen in FIG. 7.

The forward end 60 of housing 48 includes a boss 62 having a cylindrical mounting opening or bore 66 formed therein. This aperture is, as seen in FIG. 4, located to be in generally axial alignment with the drive blade 68 of staple gun tacker 10 when housing 12 is mounted thereon.

A cylindrical bushing 70 is mounted in aperture 66. This bushing is preferably formed of metal (e.g. steel), while the housing itself is formed of a plastic material, such as for example, a plastic sold under the trademark "Lexan" and preferably having a glass fill mixed therein. The bushing is freely slidably mounted in bore 66 and serves multiple purposes. More specifically, the bushing serves as a guide and wear surface for a pin or drive punch 72 which is slidably mounted therein. This punch, also formed of metal, is used to transmit the driving force of blade 68 from the staple gun tacker to drive pin 40 of the rivet.

Punch 72 has a lower cylindrical shank portion 72*a* and an upper blade portion 72*b* formed therewith which defines 72*c* above shank portion 72*a*. Blade portion 72*b* has a width substantially equal to that of blade 68. Shank portion 72*a* is received in a bore 74 of bushing 70 which includes an upper bore portion 74*a*, having a diameter slightly larger than the width of the shoulders 72*c* of the punch, and a lower portion 74*b* whose diameter is smaller than the bore portion 74*a* but slightly greater than the diameter of the shank portion 72*a* of the punch.

A coil spring 76 is positioned between the shoulders 72*c* of punch 72 and the smaller diameter section 74*b* of the bushing bore, within the larger bore portion 74*a* of the bushing. This spring serves to keep the punch in the position shown in FIG. 4 of the drawing, so that the free end 78 of the pin punch is located within and spaced from the free end 80 of the bushing itself.

A rigid retention plate 82 is mounted on the innerside of housing 12, as illustrated in FIG. 4. This plate is held on the bottom plate 84 of the one-piece housing attachment 12 by a bolt 86 and nut 88 or a rivet, or in any other convenient manner. The retention plate has an elongated aperture or slot 90 formed therein which receives the upper blade portion 72*b* of punch 72 but which has as width that is less than tge diameter of shank 72*a*. This plate prevents inadvertent removal of the punch from the housing when the housing is detached from the staple gun tacker during storage or the like. The punch, of course, cannot be removed through the bushing itself since the boss defined by shouldered 72*c* is of agreater dimension than the bore portion 74*b* of the bushing. Likewise, the bushing cannot be removed from housing 12 because it is retained with punch 72 in the housing by the plate 82. It cannot be removed in the opposite direction, through boss 60 of the housing, because of its peripheral flange 92 which seats on a shoulder 94 internally formed in the housing.

Pin punch 72, as mentioned, is dimensioned such that in its at-rest configuration, spring 76 maintains the pin punch with its free-end 78 located inwardly of the extreme free end 80 of the bushing 70. This leaves a recess in the bore section 74*b* of the bushing that is adapted to receive the upper end 96 of rivet drive pin 40. Thus, when the riveting attachment of the present invention is mounted on the end of the staple gun tacker, it is relatively easy for the operator to align the bushing, and thus pin punch 72, with the drive pin 40 of the rivet by simply seating the head end 96 of the rivet drive pin in the lower bore section 74*b* of the bushing. With the rivet located in the bushing in this manner, the staple gun tacker can be operated in the conventional manner to drive pin punch 72 and thus pin 40.

Figure 5:
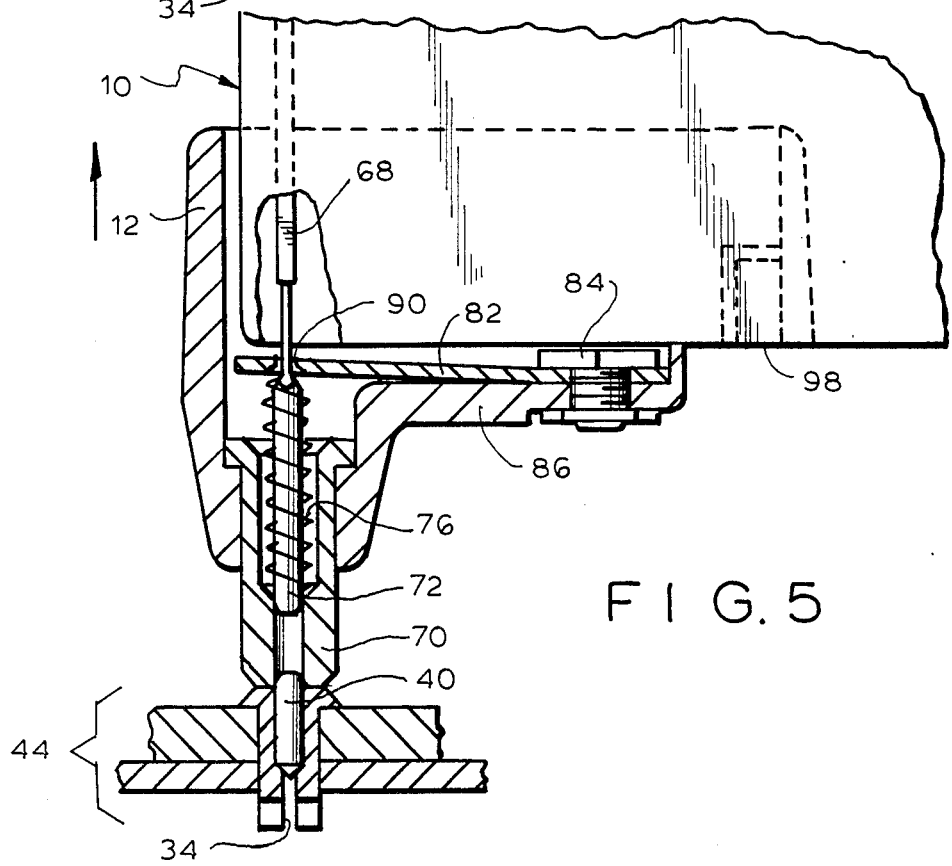
FIG. 5 is a side sectional view similar to FIG. 4 illustrating the position of the components of the attachment when the staple gun tacker is operated at the moment just prior to firing of the driving blade of the tacker.

More particularly, to drive pin 40 once the pin's end 96 is aligned in the bore of bushing 70, handle 12 of the staple gun tacker is squeezed in the conventional manner. As is known, in the operation of the staple gun tacker in this manner, drive blade 68 is raised by the operating mechanism (not shown) relative to the bottom 98 of the staple gun tacker. In the operation of the staple gun tacker as a stapler, the raising of the drive blade permits the magazine construction to move a staple into position beneath the blade. In this mode of operation, with the riveting attachment secured thereto however, no staples are present in the magazine, or the magazine itself is removed. In either event, there are no staples present to interfere with operation of the rivet driving device. When the handle is squeezed, as illustrated in FIG. 5, the blade 68 is raised. The pin punch 72 follows the movement of the blade, under the influence of spring 76, to the extent permitted by plate 82.

Figure 6:
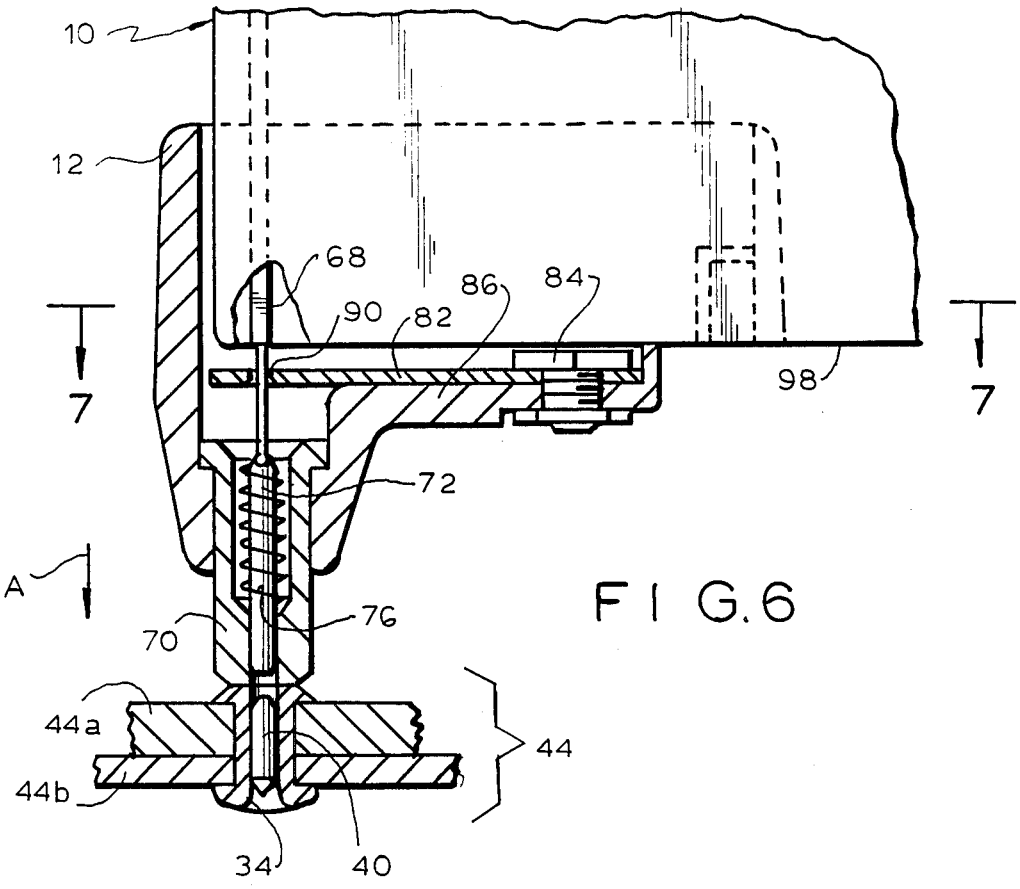
FIG. 6 is a side sectional view similar to FIGS. 4 and 5 showing the configuration of the device and the operation thereof after firing of the driving blade of the staple gun tacker.

Once handle 12 is squeezed beyond a predetermined point, the operating mechanism of the staple gun tacker fires, to drive blade 68 downwardly with a predetermined force in a known manner. This downward movement of blade 68, from the position shown in FIG. 5 to the position shown in FIG. 6, imparts a substantial amount of energy to pin punch 72 and drives the punch downwardly, in the direction of the arrow A in FIG. 6, against the upper end 96 of rivet drive pin 40. This impact force pushes rivet drive pin 40 down through the bore of the rivet into the lower bore section thereof and causes the lower end of the rivet to spread apart, as illustrated in FIG. 6, thus forming a secure attachment between the workpiece elements 44*a* and 44*b*.

By this construction of the invention, a relatively simple attachment is provided which enables a conventional staple gun tacker, which is presently owned by millions of homeowners in the United States, to be used for an additional purpose, namely the installation of rivets. Thus, the homeowner can install rivets in workpieces without the need for buying an additional complete special purpose tool. All that the homeowner requires now is this additional attachment.

As mentioned, applicants have found that the use of this attachment with a specially designed rivet having particular tolerances, enables the rivets to be driven safely, accurately and surely in a wide variety of workpieces.

Although the present invention has been described with reference to the preferred embodiment illustrated in the drawings, it is to be understood that various changes and modifications may be effected therein by those skilled in the art without departing from the scope or spirit of this invention.

What is claimed is:

1. An attachment for connection to and use with a staple gun tacker having an outer housing including a working end and a staple driving blade mounted in said working end for reciprocating movement, said attachment being adapted for use in installing or setting a rivet of the type having a pin member mounted in a headed rivet shank having an expandable workpiece piercing free end, said attachment comprising a one piece attachment housing having a recess formed therein for receiving and being directly and removably mounted on said outer housing at said working end of said staple gun tacker and having a bore formed therein located to be in axial alignment with said staple driving blade when the attachment housing is mounted on said outer housing of the staple gun tacker, a hollow bushing mounted in said housing bore and having a flange formed thereon cooperating with a shoulder in said housing to limit outward movement of said bushing relative to the housing, a punch slidably mounted in said bushing for axial movement therein, said punch having a free driving end and an opposed impact end located within said attachment housing; spring means for biasing said bushing away from said housing to cause the flange of the bushing to engage the shoulder of the housing and to retract into the housing against the bias of the spring means; said bushing and punch being positioned in said attachment housing such that the impact end of the punch in impacted by said driving blade of the staple gun tacker when the staple gun tacker is operated to apply a driving force thereto which drives the punch to engage the drive end of the punch with the pin member of the rivet to drive the pin member to expand the free end of the rivet; and means for preventing inadvertent removal of the punch from the attachment housing when the attachment is removed from the staple gun tacker.

2. The attachment as defined in claim 1 wherein said punch has its length dimensioned such that said free end is located within the bushing whereby the bore of the bushing is adapted to receive the pin member of the rivet and the bushing thus automatically aligns the punch and pin member prior to operation of the staple gun tacker.

3. An attachment as defined in claim 1 wherein said spring means biases said punch to a normal position in which said free driving end thereof is maintained within the bushing.

4. An attachment as defined in claim 3 including means for frictionally mounting said attachment housing on said outer housing of said staple gun tacker.;

5. An attachment as defined in claim 3 wherein said punch includes means forming an intermediate enlarged shoulder and said spring means is captured in the bushing beneath said shoulder.

6. An attachment as defined in claim 5 wherein the bushing has a bore formed therein adapted to receive said shoulder.

7. An attachment as defined in claim 5 wherein said preventing means is a plate mounted in the housing and having an aperture therein receiving said punch above said shoulder.

8. An attachment as defined in claim 7 wherein said impact end of said punch is flat and generally complementary in shape to said blade.

9. The combination comprising:

(i) a rivet having a pin member movably mounted in a headed rivet shank, which shank has an expandable workpiece piercing free end; and (ii) an attachment for a staple gun tacker to be used to drive said pin member, which staple gun tacker includes an outer housing having a working end and a staple driving blade mounted in said working end, said attachment being adapted to transmit the driving force of the driving blade to the pin member of the rivet and includes a one piece housing having a recess formed therein adapted to receive and be mounted on said working end of the staple gun tacker; said one piece housing having an elongated bore formed therein located to be generally in axial alignment with the driving blade of the staple gun tacker when the attachment housing is mounted on and receives said working end of the staple gun tacker; a bushing mounted in said bore; said bushing having a free end and an axial bore formed therein an alignment with said attachment housing bore; said bushing bore having a first section at the free end of the bushing and a second section in the remainder of the bushing with the second section being of larger diameter than the first, said bushing also having a flange formed thereon cooperating with a shoulder in said housing to limit outward movement of said bushing relative to the housing, a punch slidably mounted in the bore of said bushing for axial movement therein; said punch having an impact end normally located within the attachment housing and a free driving end for engaging and driving the pin member of the rivet when driven by the driving blade of the staple gun tacker; spring means for biasing said bushing away from said housing to cause the flange of the bushing to engage the shoulder of the housing and to retract into the housing against the bias of the spring means; said bushing and punch being positioned such that the punch is impacted by the driving blade when the staple gun tacker is operated to apply a driving force thereto which is used to drive the pin member of the rivet to expand the free end of the rivet; and means for preventing inadvertent removal of the punch from the attachment housing when the attachment housing is removed from the staple gun tacker.

10. The combination as defined in claim 9 wherein said punch free end is dimensioned to slide in the first bore section of the bushing and to be located within the bore inwardly of the free end of the bushing whereby said first bore section is adapted to receive the pin member of the rivet and thereby automatically align the punch and pin member prior to operation of the staple gun tacker.

11. The combination as defined in claim 10 wherein said drive pin has a diameter of 0.077 inches±0.002 and said rivet has a bore receiving the drive pin which has a diameter of $$.080 \text{ inches} \pm {}^{.003}_{.000}.$$

12. The combination as defined in claim 11 wherein said pin member includes knurl ribs thereon having diameters of between 0.081" and 0.085".

13. The combination as defined in claim 10 wherein said spring means biases said punch to a normal position in which said free driving end thereof is maintained within the bushing.

14. The combination as defined in claim 13 including means for frictionally mounting said housing on the staple gun tacker.

15. The combination as defined in claim 14 wherein said punch includes means forming an intermediate enlarged shoulder and said spring means is captured in second bore section of the bushing between said shoulder and the first bore section.

16. The combination of a rivet having a pin member mounted in a headed rivet shank which has an expandable workpiece piercing free end, and an attachment for a tacker having a driving blade, said attachment being adapted to transmit the driving force of the driving blade to the pin member of the rivet and including a housing adapted to be mounted on the working end of the tacker and having a mounting bore formed therein generally in axial alignment with the driving blade of the tacker when the housing is mounted thereon, a bushing mounted in said mounting bore having a free end and an axial bore formed therein, said bushing bore having a first section at the free end of the bushing and a second section in the remainder of the bushing with the second section being of larger diameter than the first, said bushing also having a flange formed thereon cooperating with a shoulder in said housing to limit outward movement of said bushing relative to the housing, a punch slidably mounted in the bore of said bushing for axial movement therein; spring means for biasing said bushing away from said housing to cause the flange of the bushing to engage the shoulder of the housing and to retract into the housing against the bias of the spring means; said bushing and punch being positioned such that the punch is impacted by the driving blade when the tacker is operated to apply a driving force thereto which is used to drive the pin member of the rivet to expand the free end of the rivet; said punch including a free end dimensioned to slide in the first bore section of the bushing and to be located within the bore inwardly of the free end of the bushing whereby said first bore section is adapted to receive the drive member of the rivet and thereby automatically align the punch and pin member prior to operation of the tacker; said spring means biasing said bushing to a normal position in which said free driving end of the punch is maintained within the bushing; means for preventing inadvertent removal of the punch from the housing when the attachment is removed from the tacker; means for frictionally mounting said housing on the tacker; said punch including means forming an intermediate enlarged shoulder and said spring means being captured in said second bore section of the bushing between said shoulder and the first bore section; and said preventing means comprising a plate mounted in the housing and having an aperture therein receiving said punch above said shoulder.

* * * * *